United States Patent [19]

Hickson et al.

[11] Patent Number: 4,817,955

[45] Date of Patent: Apr. 4, 1989

[54] GOLF BALL DISPENSER AND TEE APPARATUS

[76] Inventors: Donald N. Hickson, 3313 - 6th Avenue S., Lethbridge, Alberta, Canada, T1J 1G4; Gerald W. Todd, S.S. L-3-44, Lethbridge, Alberta, Canada, T1J 4B3; Edward A. Seskus, 2616 South Parkside Drive, Lethbridge, Alberta, Canada

[21] Appl. No.: 135,643

[22] Filed: Dec. 21, 1987

[51] Int. Cl.[4] ..... A63B 57/00

[52] U.S. Cl. ..... 273/201; 124/51 R

[58] Field of Search ..... 273/201, 29 A, 26 R, 273/359, 369, 399, 184 R, 186 R; 124/51 R, 45–50, 41 R, 16; 269/20–22, 24, 35

[56] References Cited

U.S. PATENT DOCUMENTS

| | | | |
|---|---|---|---|
| 4,360,204 | 11/1982 | Karr | 273/201 |
| 4,732,391 | 3/1988 | Karr | 273/201 |
| 4,741,537 | 5/1988 | Adam | 273/201 |

*Primary Examiner*—Maryann Lastova

*Attorney, Agent, or Firm*—George H. Dunsmuir

[57] ABSTRACT

A golf ball dispenser and tee apparatus includes a cylindrical hopper for carrying a plurality of golf balls, a rotatable disc mounted in the hopper above the floor thereof with a plurality of holes, a cover for covering one of the holes when the hole is aligned with an opening in the floor of the hopper, so that the golf balls are discharged one at a time into an inclined tube, a motor for rotating the disc in the hopper, a coin operated switch for initiating operation of the motor, a gripper mounted on a slide at the end of the inclined tube for gripping a golf ball when actuated by a switch which is operated by the head of a club, and a second motor for moving the slide with the gripper outwardly to a position where the ball is deposited on a tee, and returning the slide and gripper to the rest position for gripping another ball. The gripper is operated by a solenoid and operation of the slide motor is achieved by microswitches.

12 Claims, 5 Drawing Sheets

GOLF BALL DISPENSER AND TEE APPARATUS

BACKGROUND OF THE INVENTION

This invention relates to a golf ball dispensing apparatus, and in particular to a combination golf ball dispensing and tee apparatus.

Apparatuses of the type disclosed herein are known. Examples of such apparatuses are found in Canadian Pat. Nos. 1,050,068, which issued to K. Izumi on Mar. 6, 1979; 1,108,201, which issued to A. Stone on Sept. 1, 1981; 1,113,521, which issued to J. Eberle on Dec. 1, 1981; 1,116,199, which issued to R. Loof on Jan. 12, 1982 and 1,167,077, which issued to R. J. Karr on May 8, 1984, and U.S. Pat. Nos. 3,003,770, which issued to R. O. Jones on Oct. 10, 1961; 3,127,177, which issued to E. Benkoe on Mar. 31, 1964; 3,599,983, which issued to R. L. Melton on Aug. 17, 1971; 3,738,662, which issued C. L. Hodgin on June 12, 1973, and 3,758,118, which issued to L. J. Willcox on Sept. 11, 1973. In general, the patented devices are unduly complicated either in terms of structure or in terms of operation. Many of the devices do not lend themselves to coin operation.

The object of the present invention is to overcome the problems inherent to existing machines by providing a relatively simple golf ball dispensing and tee apparatus of the coin-operation type.

BRIEF SUMMARY OF THE INVENTION

Accordingly, the present invention relates to a golf ball dispenser and tee apparatus comprising hopper means for carrying a plurality of golf balls; feed means in said hopper means for dispensing golf balls one at a time; first drive means for operating said feed means; tube means for receiving golf balls one at a time from said feed means; stop means at an open free end of said tube means remote from said hopper means movable between ball retaining and release positions for releasably retaining said golf balls in said tube means; gripper means for gripping a golf ball at said open free end of said tube means; slide means carrying said gripper means for moving a golf ball out of said tube means, whereby said stop means is moved to the release position, and upon release of a golf ball from said tube means immediately returns to the ball retaining position; tee means remote from said open free end of said tube means for receiving a ball from said gripper means; second drive means for operating said slide means to cause said gripper means to move between a retracted ball pick-up position and an extended ball depositing position above said tee means; first, coin actuated control means for controlling operation of said first drive means to deposit a predetermined number of golf balls in said tube means; and second, user operated control means for controlling operation of said second drive means to cause said slide means and gripper means to move to the ball depositing position, and to cause said gripper means to release a ball onto said tee means.

BRIEF DESCRIPTION OF THE DRAWINGS

The invention will be described in greater detail with reference to the accompanying drawings, which illustrate a preferred embodiment of the invention, and therein.

Figure 1:
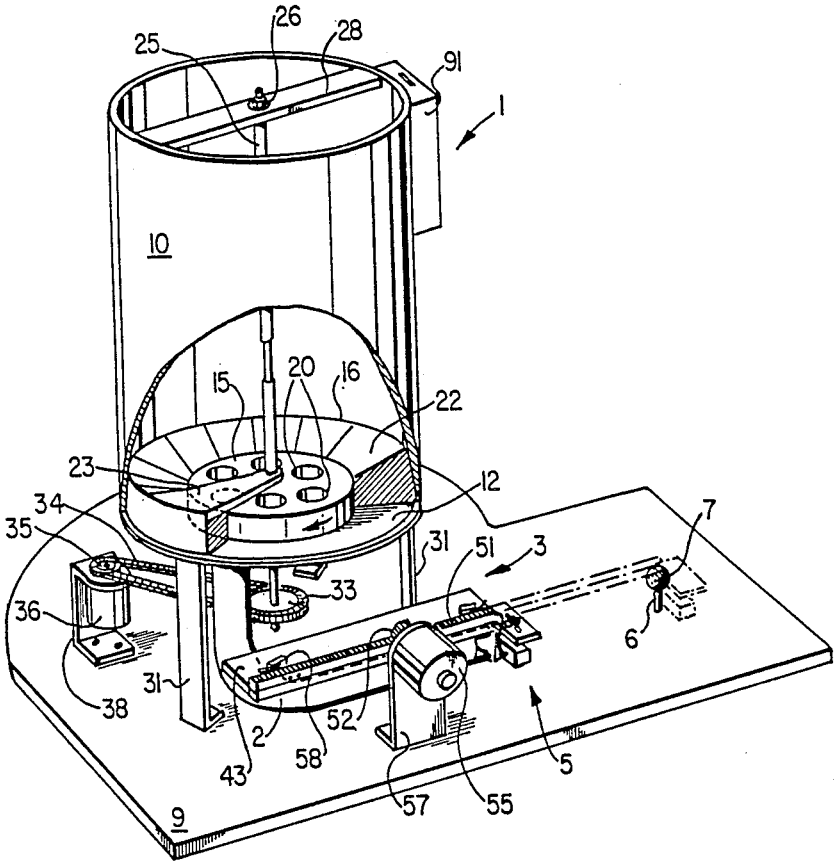
FIG. 1 is a schematic, partly sectioned perspective view of a golf ball dispenser and tee apparatus in accordance with the present invention.
Figure 2:
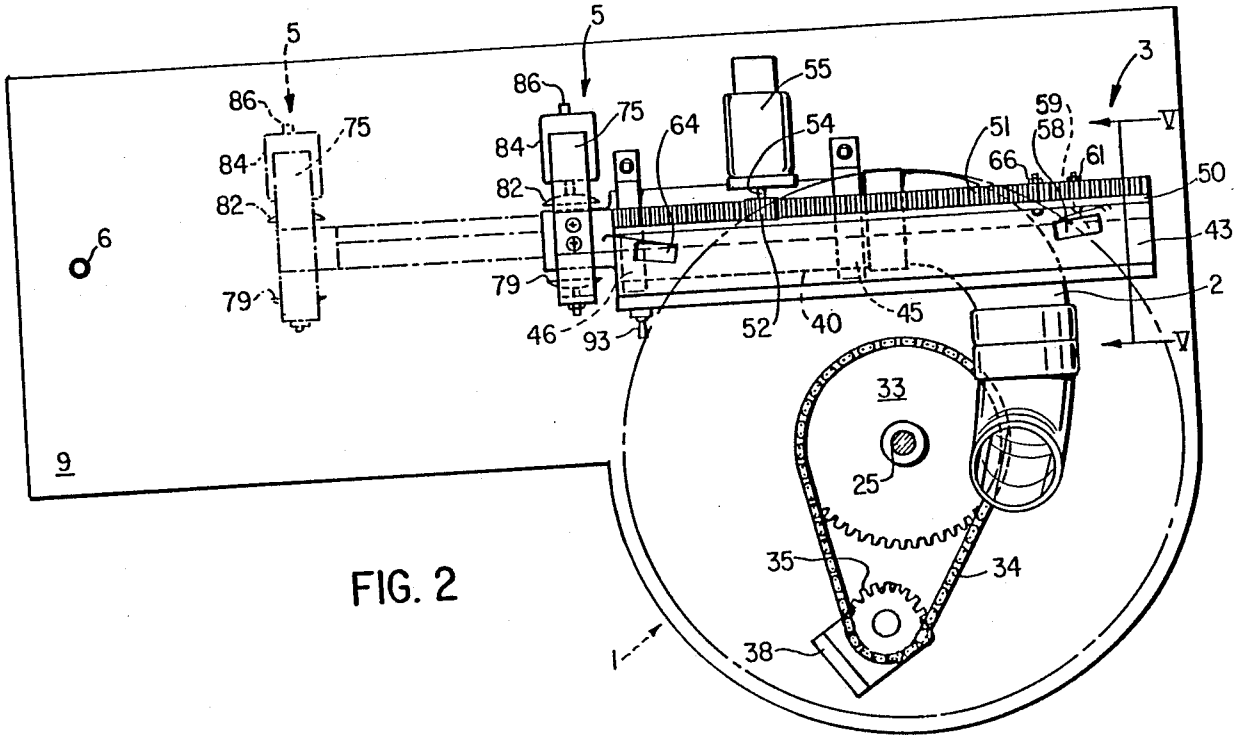
FIG. 2 is a plan view of the apparatus of FIG. 1.

It will be noted that for the sake of simplicity elements have been omitted from each of FIGS. 1 and 2.

DESCRIPTION OF THE PREFERRED EXHIBIT(S)

With reference to the drawings, the basic elements of the golf ball dispenser and tee apparatus of the present invention include a hopper generally indicated at 1, a tube 2 for receiving golf balls from the hopper 1, a slide device generally indicated at 3, a gripper generally indicated at 5 and a tee 6 for golf balls 7. All of the elements of the apparatus are mounted on a planar base 9.

Figure 3:
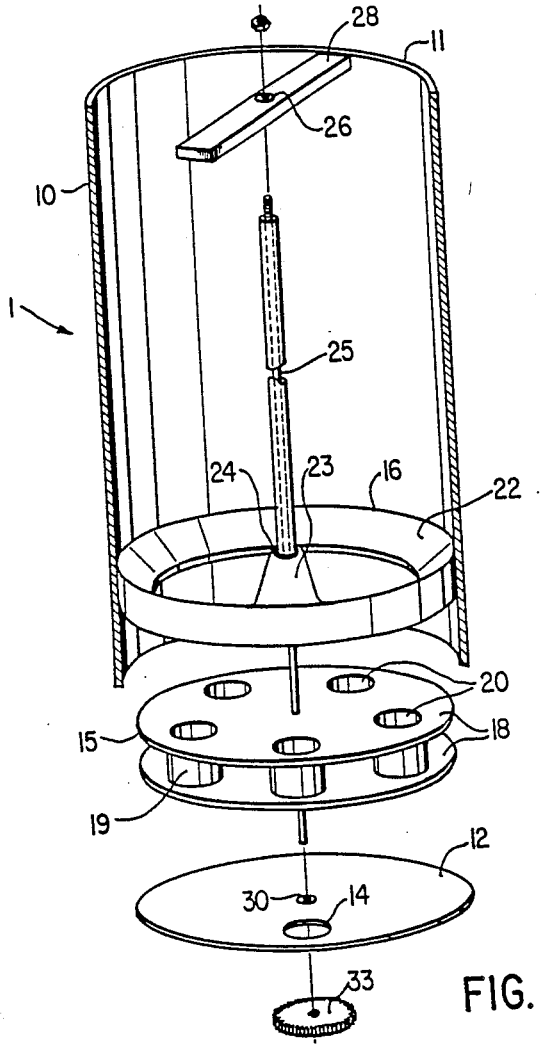
FIG. 3 is a partly sectioned, exploded, schematic, perspective view of a hopper used in the apparatus of FIGS. 1 and 2.

As best shown in FIGS. 1 and 3, the hopper 1 is defined by a cylindrical casing 10 with an open top end 11 and a bottom wall 12. A single opening 14 is provided in the bottom wall 12 for discharging golf balls 7, one at a time into the tube 2. The discharging of golf balls is controlled by a dispensing disc 15 and a cover 16 for such disc 15. The disc 15 includes a pair of spaced apart circular plates 18 interconnected by short tubes 19 extending into openings 20 in such plates. The cover 16 is defined by a ring 22 with an arm 23 extending radially inwardly therefrom. The arm 23 is vertically aligned with the opening 14 in the bottom wall 12 of the casing 10. The top surface of the arm 23 is arcuate for facilitating the movement of golf balls thereover. A bearing 24 is provided in the inner end of the arm 23. The disc 15 is fixedly mounted on a shaft 25, which extends along the longitudinal axis of the casing 10 from a bearing 26 in a top support crossbar 28 through the bearing 24 and a bearing 30 in the bottom wall 12 to beneath the casing 10.

The cover 16 is fixedly mounted on the wall of the casing 10. Thus, with the dispenser 10 full of golf balls, each of the tubes 19 will contain a ball, and rotation of the disc 15 to beneath the arm 23 will result in the balls in such tubes 19 dropping one at a time through the opening 14 into the tube 2. The arm 23 is vertically aligned with the opening 14, so that when a ball 7 is being discharged into the tube 2, additional balls cannot follow the single ball into the tube. The casing 10 is mounted on the base 9 by means of legs 31, so that the bottom wall 12 of the casing and the bottom end of the shaft 25 are spaced above the base 9.

The shaft 25 is rotated by a sprocket wheel 33 on the bottom end thereof which is connected by a chain 34 to a second sprocket wheel 35 on the shaft of a motor 36. The motor 36 is supported by a bracket 38 mounted on the base 9.

Figure 4:
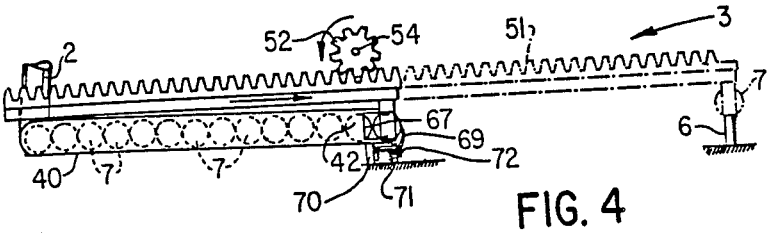
FIG. 4 is a schematic side vie of a slide used in the apparatus of FIGS. 1 and 2.

As illustrated in FIG. 4, the bottom arm 40 of the tube 2 is inclined forwardly, so that golf balls 7 roll towards the discharge end 42 of such tube. The balls 7 are moved from the discharge end 42 of the tube 2 to the tee 6 by the slide device 3 and the gripper 5. The slide device 3 is connected to a platform 43 (FIGS. 1 and 2).

Figure 5:
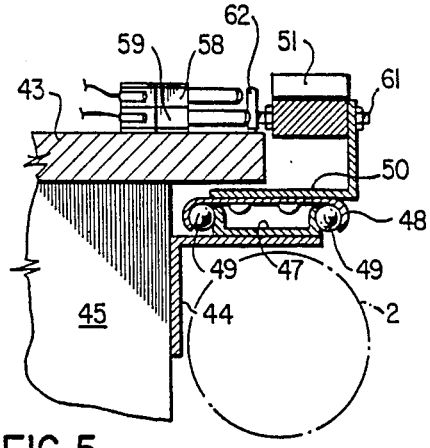
FIG. 5 is a cross-sectional view of the slide of FIG. 4 taken generally along line V—V of FIG. 2.

An elongated L-shaped bracket 44 (FIG. 5) is mounted on a leg 45 and the front end wall 46 (FIG. 6) of the platform 43. A generally U-shaped track 47 is provided on the bracket 44 for slidably supporting a slide 48. The slide 48 is carried on the track 47 by balls 49 located between the track 47 and the slide 48. A reverse L-shaped bracket 50 is mounted on the slide 48. The bracket 50 extends around one side edge of the platform 43 for supporting an elongated rack 51. The teeth of the rack 51 are engaged by a pinion 52 mounted on a shaft 54 of a motor 55. The motor 55 is mounted on stand 57 which is connected to the base 9. A pair of vertically aligned 25 limit switches 58 and 59 are provided at the inner end of the platform 43 for closing by a bolt 61 in the rear end of the rack 51 and a lug 72. Another micro-switch 64 is provided on the front end of the platform 43 for closing by another bolt 66 at the rear end of the rack 51.

A pair of opposed rectangular grooves 67 (FIGS. 4 and 6) are provided in the open front end 43 of the tube 2. The row of golf balls 7 is releasably retained in the arm 40 of the tube 2 by a generally L-shaped arm 69, the rear end of which is pivotally connected to the front wall 46 of the platform 43. A pin 71 carrying a helical spring 72 is mounted on the base 9 and extends upwardly through an opening 74 in the arm 69. Thus, the arm 69 can be rotated downwardly against the action of the spring 72 to release a golf ball 7. As soon as the golf ball 7 passes the outer end of the arm 69, the spring 72 returns the arm to the rest position blocking the end 42 of the tube 2.

Figure 6:
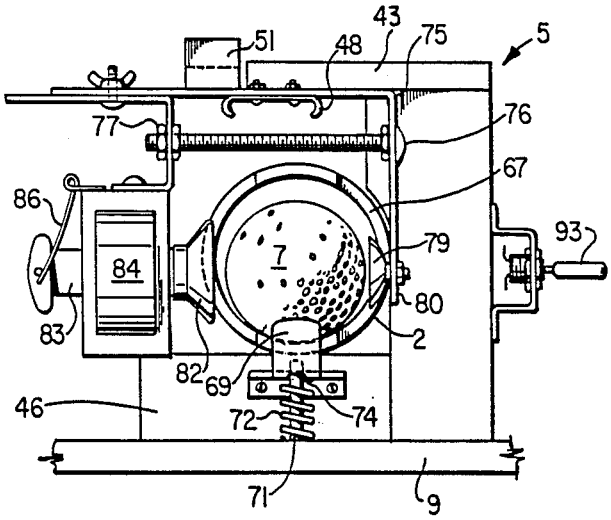
FIG. 6 is an end view of a gripper used in the apparatus of FIGS. 1 and 2.

Each golf ball 7 is moved out of the tube 2 by means of the gripper 5. As best shown in FIG. 6, the gripper 5 includes an inverted U-shaped bracket 75 mounted on the slide 48. The sides of the bracket 75 are connected together by a bolt 76 and nuts 77. A first suction cup 79 is fixedly mounted in one arm 80 of the bracket 75 on one side of the open front end 42 of the tube 2. A movable suction cup 82 is mounted on the plunger 83 of a solenoid 84 on the other side of the open end 42 of the tube 2. The plunger 83 of the solenoid 84 is normally biased to the retracted or outer position (FIG. 6) by a spring 86.

By energizing the solenoid 84, the plunger 83 is caused to move inwardly, whereby a golf ball 7 is gripped between the suction cups 79 and 82. If the motor 55 is energized, the rack 51 and the slide 48 attached thereto are caused to move outwardly to carry the gripper 5 to the outer position above the tee 6, as shown in phantom outline in FIGS. 1 and 2.

Figure 7:
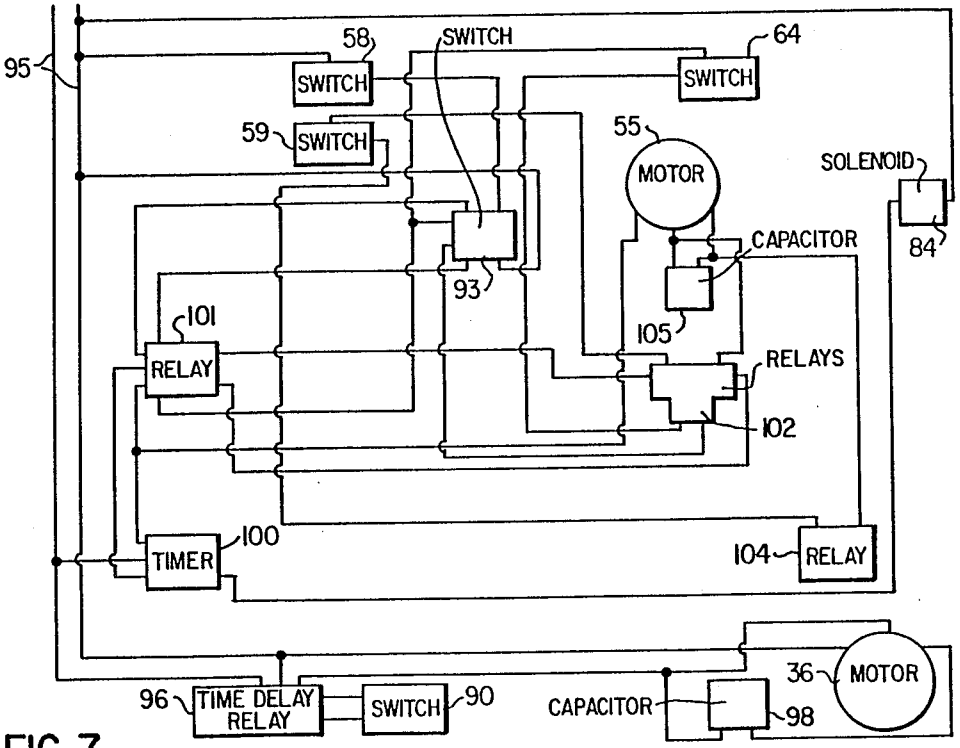
FIG. 7 is a schematic diagram of the electrical circuit used in the apparatus of FIGS. 1 and 2.

Initiation of operation of the above described mechanical elements is effected by a coin-operated switch 90 (FIG. 7) located in a coin box 91 (FIG. 1) mounted on the top end of the hopper casing 10. A toggle switch 93 (FIGS. 2 and 7) mounted on one side of the platform 43 beneath the front end of the slide device 3 controls movement of the slide device. The toggle switch 93 is actuated by the head of a golf club. With reference to FIG. 7, the motors 36 and 55 for operating the hopper feed and the slide device 3, respectively, the micro switches 58, 59 and 64, the solenoid 84, and the switches 90 and 93 form part of a control circuit. The circuit includes electrical leads 95 connected to a source of 110 volt A.C. power (not shown), i.e. the apparatus is simply plugged into a conventional electrical wall outlet. The leads 95 are connected to the switch 90, a time delay relay 96, and a capacitor 98 for controlling the hopper motor 36.

When a coin is inserted into the box 91, the switch 90 is closed to start the motor 36. The motor 36 rotates the shaft 25 and the disc 15 a number of times dictated by the relay 96 to deposit a predetermined number of golf balls 7 in the tube 2. The motor 36 stops, and the next step in the procedure can be performed. When the golfer is ready, the switch 93 is closed using the head of a golf club. Power is transmitted through a timer 100 to the solenoid 84, so that the gripper 5 closes to grip the forwardmost golf ball 7 in the arm 40 of the tube 2. After a short delay current is fed through relays 101 and 102 to the motor 55. Operation of the motor advances the gripper 5 to a position where the ball 7 is on the tee 6. This action closes the switches 58 and 59 which (a) de-energize the solenoid 84 to cause releasing of the ball 7, and (b) through a relay 104 and a capacitor 105, cause the motor 55 to reverse, whereby the slide 3 is returned to the retracted or rest position.

Return of the slide device 3 to the rest position closes the switch 64, so that the switch 93 can again be closed to initiate gripping and feeding of another golf ball 7.

Thus, there has been described a relatively simple golf ball dispenser and tee apparatus, which has two control features, namely a coin operated feeder for dispensing a pre-determined number of golf balls and a club actuated slide for moving balls one at a time to a tee.

What we claim is:

1. A golf ball dispenser and tee apparatus comprising hopper means for carrying a plurality of golf balls; feed means in said hopper means for dispensing golf balls one at a time; first drive means for operating said feed means; tube means for receiving golf balls one at a time from said feed means; stop means at an open free end of said tube means remote from said hopper means movable between ball retaining and release positions for releasably retaining said golf balls in said tube means; gripper means for gripping a golf ball at said open free end of said tube means; slide means carrying said gripper means for moving a golf ball out of said tube means, whereby said stop means is moved to the release position, and upon release of a golf ball from said tube means immediately returns to the ball retaining position; tee means remote from said open free end of said tube means for receiving a ball from said gripper means; second drive means for operating said slide means to cause said gripper means to move between a retracted ball pick-up position and an extended ball depositing position above said tee means; first, coin actuated control means for controlling operation of said first drive means to deposit a predetermined number of golf balls in said tube means; and second, user operated control means for controlling operation of said second drive means to cause said slide means and gripper means to move to the ball depositing position, and to cause said gripper means to release a ball onto said tee means.

2. An apparatus according to claim 1, including a first motor means for operating said feed means; first, coin actuated switch means for starting said first motor means; and first timer means permitting operating of said motor means for a set period of time, whereby a predetermined number of golf balls is dispensed into said tube means for each coin.

3. An apparatus according to claim 2, wherein said feed means includes an orifice in said hopper means for discharging a golf ball into said tube means; disc means connected to said first drive means for rotation over said orifice; and a plurality of discharge openings in said disc means for alignment one at a time with said orifice.

4. An apparatus according to claim 3, including cover means for covering one said opening when the opening and orifice are aligned, whereby the balls are dispensed one at a time.

5. An apparatus according to claim 2, wherein said stop means includes arm means pivotal between said ball retaining and release positions; and first spring means biasing said arm means into said ball retaining position.

6. An apparatus according to claim 2, including platform means; track means on said platform means; a rack means carrying said gripper means slidably mounted on said track means; and pinion means connected to said second drive means for moving said rack means along said track means.

7. An apparatus according to claim 6, wherein said gripper means includes bracket means on one end of said rack means; fixed cup means on one side of said bracket means; movable cup means on the other side of said bracket means in opposition to said fixed cup means for movement towards and away from said first cup means for gripping a golf ball.

8. An apparatus according to claim 7, including solenoid means carrying said movable cup means and connected to said second control means.

9. An apparatus according to claim 8, including second spring means for returning said movable cup means to a rest position.

10. An apparatus according to claim 9, wherein said second control means includes timer means connected to said solenoid means and to said second drive means for initiating operation of said second drive means and outward movement of said rack means.

11. An apparatus according to claim 10, wherein said second control means includes second switch means for closing by a golf club head to actuate said second drive means.

12. An apparatus according to claim 11, wherein said second control means includes third switch means for actuation by said rack means for causing said second drive means to reverse, whereby said rack means is returned from an extended ball depositing position to a retracted rest position.

* * * * *